US006195063B1

(12) United States Patent
Gabriel et al.

(10) Patent No.: US 6,195,063 B1
(45) Date of Patent: Feb. 27, 2001

(54) DUAL-POLARIZED ANTENNA SYSTEM

(75) Inventors: Roland Gabriel; Max Göttl, both of Grosskarolinenfeld; Georg Klinger, Saaldorf-Surheim, all of (DE)

(73) Assignee: Kathrein-Werke KG (DE)

( * ) Notice: Subject to any disclaimer, the term of this patent is extended or adjusted under 35 U.S.C. 154(b) by 0 days.

(21) Appl. No.: 09/230,523

(22) PCT Filed: May 27, 1998

(86) PCT No.: PCT/EP98/03129

§ 371 Date: Jan. 27, 1999

§ 102(e) Date: Jan. 27, 1999

(87) PCT Pub. No.: WO98/54787

PCT Pub. Date: Dec. 3, 1998

(30) Foreign Application Priority Data

May 30, 1997 (DE) ..... 197 22 742

(51) Int. Cl.[7] ..... H01Q 1/22

(52) U.S. Cl. ..... 343/797; 343/700 MS; 343/767; 343/770; 343/798; 343/817

(58) Field of Search ..... 343/700 MS, 789, 343/795, 797, 798, 803, 809, 810, 813, 814, 817, 819, 767, 770; H01Q 1/22, 1/38

(56) References Cited

U.S. PATENT DOCUMENTS

| | | | | |
|---|---|---|---|---|
| 5,481,272 | | 1/1996 | Yarsunas | 343/797 |
| 5,710,569 | * | 1/1998 | Oh et al. | 343/817 |
| 5,874,924 | * | 2/1999 | Csongor et al. | 343/797 |
| 5,892,485 | * | 4/1999 | Glabe et al. | 343/789 |
| 5,896,107 | * | 4/1999 | Huynh | 343/700 MS |
| 5,936,590 | * | 8/1999 | Funder | 343/795 |

FOREIGN PATENT DOCUMENTS

| | | | |
|---|---|---|---|
| 71 42 601 | 7/1972 | (DE) | H01Q/21/24 |
| 0527417 A1 | 2/1993 | (EP) | H01Q/21/06 |
| 0685900 | 12/1995 | (EP) | H01Q/9/04 |
| 0730319 A1 | 9/1996 | (EP) | H01Q/19/10 |
| 0739051 A1 | 10/1996 | (EP) | H01Q/21/06 |

OTHER PUBLICATIONS

Heilmann, A; Antennen, Zweiter Teil, Bibliographisches Institut; Mannheim/Wien/Zurich, 1970 pp 47–50.

Zehetner, H.: Neue Sandeantenne fur terrestrisches Fernsehen bei 2,6 GHz. In: UTG–Fachbericht 128, Atennen, VDE–Verlag–GmbH, Berlin, Offenbach, 1994, pp. 357–362;.ISBN 3–8007–1991–6.

De Vito, G. et al; Improved Dipol–Panel for Circular Polarization. In: IEEE Transactions on Broadcasting, vol. BC–28, No. 2, Jun. 1982, pp. 65–72.

* cited by examiner

*Primary Examiner*—Tho Phan
(74) *Attorney, Agent, or Firm*—Nixon & Vanderhye PC

(57) ABSTRACT

A dual-polarized antenna system is provided for transmitting or receiving electromagnetic waves. The antenna system has at least one cruciform radiating element module that is aligned using dipoles or in the form of a patch radiating element, at angles of +45° and −45° with respect to vertical. The antenna system further has a conductive reflector arranged in the back of the at least one radiating element module. Two conductive side wall sections are provided on each side of the at least one radiating element and are disposed vertically. At least one slot is provided in each side wall section at the level of the radiating element module and extend in parallel to the reflector plane.

15 Claims, 4 Drawing Sheets

DUAL-POLARIZED ANTENNA SYSTEM

This application is the national phase of international application PCT/EP98/03129 filed Mar. 29, 1998 which designated the U.S.

BACKGROUND OF THE INVENTION

1. Field of the Invention

The invention relates to an antenna system for transmitting and receiving electromagnetic waves, in particular to a dual-polarized antenna.

2. Description of the Related Art

Horizontally or vertically polarized radiating element arrangements, for example in the form of dipoles arranged in the polarization plane, and slots arranged transversely with respect thereto or in the form of planar radiating elements, such as patch radiating elements, have been known for a long time. In the case of horizontally polarized radiating element arrangements, the dipoles are in this case arranged horizontally. Corresponding radiating element arrangements in the form of slots are in this case arranged vertically. Radiating element arrangements are likewise known which can be used for simultaneously transmitting and receiving waves with two orthogonal polarizations, and these are also referred to as dual-polarized antennas in the following text. Corresponding radiating element arrangements, for example comprising a plurality of elements in the form of dipoles, slots or planar radiating elements, are known from EP 0 685 909 A 1 or from the publication "Antennen" [Antennas], 2nd part, Bibliographical Institute, Mannheim/Vienna/Zurich, 1970, pages 47 to 50.

In order to improve directionality, these radiating element arrangements are normally arranged in front of a reflecting surface, the so-called reflector. Furthermore, it has been found to be advantageous for mobile radio applications for dual-polarized radiating element arrangements to be skewed, for example at +45° or −45°, so that each system transmits linear polarization at +45° or −45°, and the two systems are in turn orthogonal with respect to one another.

It has been found to be disadvantageous in the case of the various radiating element types that this alignment for +/−45° polarization is in this case exact only in the main beam direction. Depending on the type of radiating element, the alignment of the polarization for a major angular deviation from the main beam direction may differ to a greater or lesser extent from the desired +45° or −45°, and is thus dependent on the propagation direction. If, for example, the radiating element type is a dipole aligned at +45° or −45°, then this is obviously comprehensible. Since only the projection of the dipole appears in the respective transmission direction, the polarization is, for example, virtually vertical at right angles to the main beam direction.

However, for +45°/−45° dual-polarized antennas, it is desirable for the alignment of the linear polarization to be independent, that is to say at least largely independent, of the transmission direction. In the case of skewed polarization planes, which may be aligned, for example, at +45° and −45°, this means that, even if the field strength vector is broken down vectorially into a horizontal and a vertical component, the polar diagrams of the vertical and horizontal individual components should have the same 3 dB beamwidth as the sum component.

Large horizontal 3 dB beamwidths of 60°–120° are preferably used for mobile radio applications; thus, in this case, the described effect of the dependency of the polarization alignment of the transmission direction in most radiating element types means that, in the horizontal polar diagrams for the vertical and horizontal individual components, the 3 dB beamwidth of the vertical component is larger than the 3 dB beamwidth of the horizontal component.

Thus, in the case of antennas with skewed polarization, in particular with the polarization plane aligned at +45° and −45°, it has been found to be disadvantageous that it is impossible to use simple means to achieve 3 dB beamwidths of more than 85°–90° and, furthermore, with the means known to date, it is impossible to achieve virtually constant polarization alignment.

It is furthermore known that vertically arranged slot radiating elements, which are energized, for example, by means of a coaxial cable, a stripline or a triplate structure, may have a horizontally polarized radiation characteristic with a comparatively large horizontal 3 dB beamwidth.

In order to achieve defined 3 dB beamwidths, EP 0 527 417 A 1, for example, proposes the use of a plurality of offset slots, which are fed by means of a stripline, for beamforming. However, a disadvantage of this configuration is that the slots have a narrower 3 dB beamwidth than the individual radiating elements, that is to say they are directed to a greater extent at the start.

The prior publication U.S. Pat. No. 5,481,272, which represents the prior art, has disclosed a circularpolarized antenna system. The radiating element module comprises two dipoles arranged in cruciform shape with respect to one another, and aligned diagonally in a reflector box whose plan view is square. In other words, the reflector box base, which is arranged parallel to the dipole surfaces, forms the actual reflector plane which is provided all round with conductive boundary walls, aligned at right angles to the reflector plane. This prior publication thus describes a cruciform dipole arrangement for circular polarization.

DE VITO, G. et al.: Improved Dipole-Panel for Circular Polarization. In: IEEE Transactions on Broadcasting, Vol. BC-28, No. 2, June 1982, pages 65 to 72 describes a cruciform dipole arrangement, likewise for circular polarizations, in which the shape of the reflector is used to influence the polar diagram. In this case, the reflector plate likewise once again has a square shape in a plan view of the dipole cruciform which is aligned diagonally above it, and is surrounded by circumferential reflector walls which are aligned, for example, at an angle of 45° to the reflector plane.

DE-GM 71 42 601 discloses a typical directional radiating element field for circular or electrical polarizations in order to form omnidirectional antennas.

Finally, the prior publication EP 0 730 319 A1 describes an antenna system having two dipole antennas which are arranged aligned vertically at a distance one above the other and are mounted in front of a reflector plate. The reflector plate is in this case provided with two side, external reflector sections or reflector vanes, which are angled forward about a bend edge running vertically and parallel to the dipoles. This is intended to change the antenna characteristic, in order to suppress transmission at the sides. To do this, the side reflector parts preferably use an edge angle which is between 45° and 90°, that is to say with 90° being at right angles to the reflector plane.

In addition, this antenna is also provided with two additional reflector rails which are fitted on the reflector surface and are located between the angled, side reflector sections and the dipoles that are seated such that they are aligned vertically, and which reflector rails have a longitudinal slot in the middle. The longitudinal slots are in this case located between the two vertical dipoles, and, in side view, are covered by the external reflector plate sections.

SUMMARY OF THE INVENTION

Based on a dual-polarized antenna which is known from the prior art of this generic type and whose linear polarizations are aligned at angles of +45° and −45° with respect to the vertical, the object of the present invention is to provide a considerable improvement by allowing the radiation characteristic to be broadened in the desired transmission plane, that is to say in particular in the horizontal transmission plane.

The present invention considerably improves the constancy of the polarization alignment of the field strength vector in a desired propagation plane over all previously known solutions and using relatively simple means, and thus considerably broadens the polar diagram in this propagation plane.

In this case, it is surprising and interesting that the slots which are provided at the sides of the radiating element modules are energized at the same time by both the +45° polarization components and the −45° polarization components. Although one would expect that this could lead to a reduction and decoupling between the +45° polarization components and the −45° polarization components, the opposite happens, however. In this case, it is possible according to the invention to define the slots and the dimensions in such a manner that the radiation contribution of the slots causes no phase shift, or only a minor phase shift, with respect to the vertical polarization component, and thus contributes to a considerable improvement in the polarization alignment of the +45°/−45° polarized antennas. The optimum transmission characteristic is achieved when, as is provided according to the invention, the slots in the sidewall sections are chosen in such a manner that they radiate other than at their resonance.

An antenna formed from a plurality of layers is admittedly known from EP 0 739 051 A1, which is defined by rectangular recesses, so-called apertures, incorporated in the ground plane. Horizontally aligned excitation pins, which are used to energize the antenna, are in each case arranged offset through 90° with respect to the vertical and transversely with respect thereto, and project into these primary apertures.

In order now to improve the 3 dB beamwidth of the radiation lobe in the horizontal main propagation direction, a further rectangular slot is in each case incorporated, located in the antenna plane, at the sides alongside the primary aperture, into which slot even further horizontal coupling pins can likewise preferably project. This is intended to enlarge the 3 dB beamwidth of the radiation lobe in the section plane of the coupling pins.

However, the antenna system according to the invention is constructed in a completely different way. Admittedly, slots located at the sides are likewise provided in the solution according to the invention. However, these slots are not used for an antenna with a layered structure but for a dipole arrangement or a patch radiating element. However, above all, the antenna according to the invention is aligned with a polarization alignment of +45° and −45° with respect to the vertical. It is highly surprising in this case that the solution according to the invention allows an improvement in the width characteristic in the main beam direction to be achieved without any deterioration occurring in the decoupling of the two polarizations. This is because, in the case of the solution according to the invention, the slots which are provided at the sides of the radiating element modules are energized at the same time by the +45° polarization components and the −45° polarization components. In this case, it should be expected that this would lead to a reduction in the decoupling between the +45° and −45° polarizations.

Furthermore, it is highly surprising that, in the case of the antenna system according to the invention, the slots can be matched by dimensions and position in such a manner that the radiation contribution of the slots causes no phase shift, or only a minor phase shift, with respect to the vertical polarization component, and thus contributes to a considerable improvement in the polarization alignment of the +45°/−45° polarized antenna (circular components would be produced for other types of matching and position).

Finally, the advantages according to the invention are obtained even if, when a reflector is provided, side walls which project out of the reflector plane are provided, in which opposite slots are incorporated approximately at the level of the primary radiating element. This results in electromagnetic coupling with the primary radiating element, as a result of which the polar diagram can now be broadened in an unexpected manner.

The side walls which are provided according to the invention on the reflector and preferably project from the reflector plane, together with the slots incorporated in them, surprisingly result in the amplitude and phase of the waves transmitted by the coupled slots being influenced in a positive manner. This is achieved as a result of the fact that cancellations occur in the main beam direction and in the rearward direction, and that additive superimpositions are achieved at right angles to the main beam direction, thus broadening the radiation characteristic.

It can furthermore be noted in a positive and surprising manner that the antenna system according to the invention has a broadband characteristic.

BRIEF DESCRIPTION OF THE DRAWINGS

The invention will be explained in the following text using exemplary embodiments and with reference to the attached drawings, in which, in detail.

DETAILED DESCRIPTION OF THE INVENTION

Figure 1:
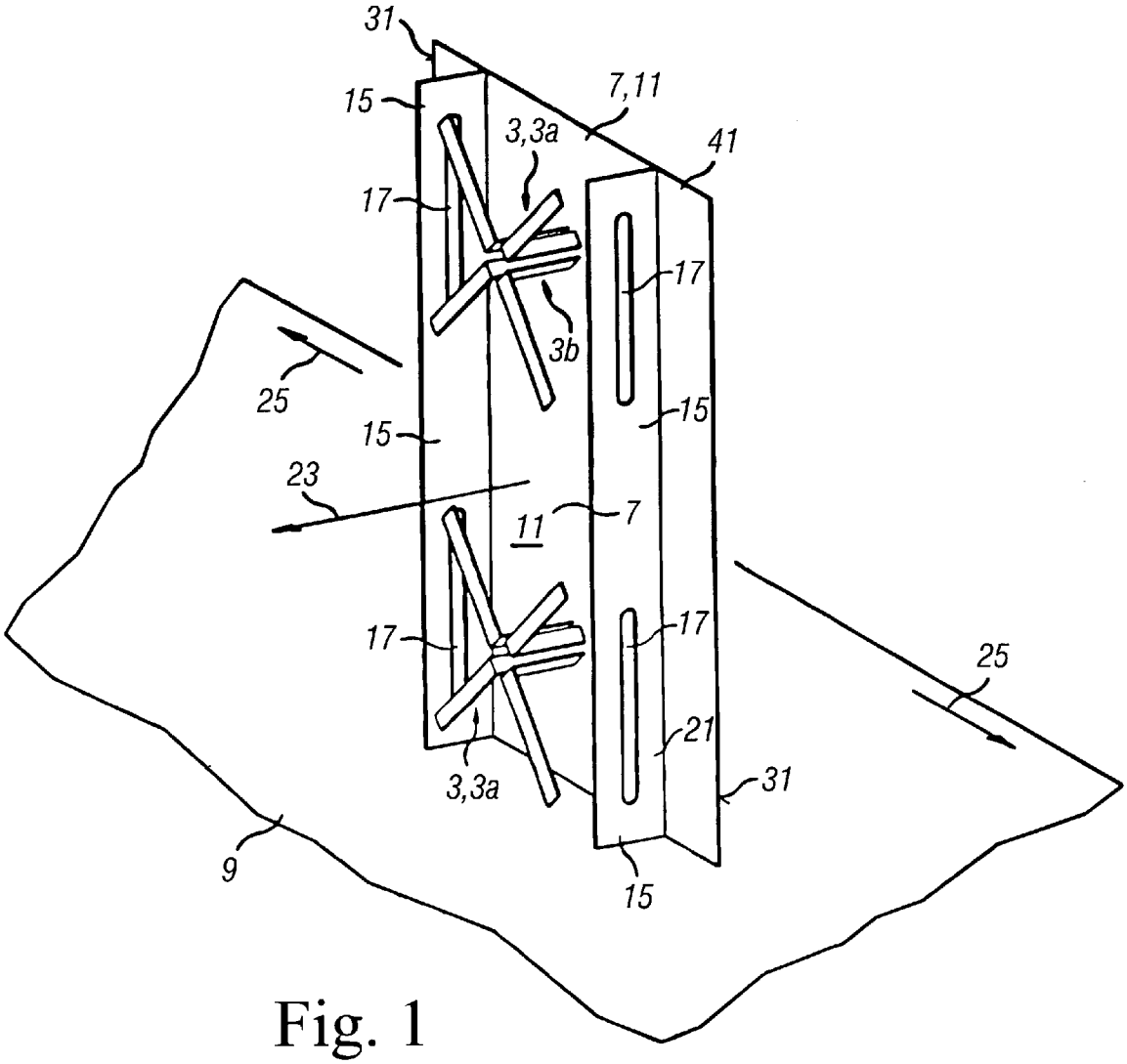
FIG. 1 shows a first schematic exemplary embodiment of a dual-polarized antenna system.
Figure 2:
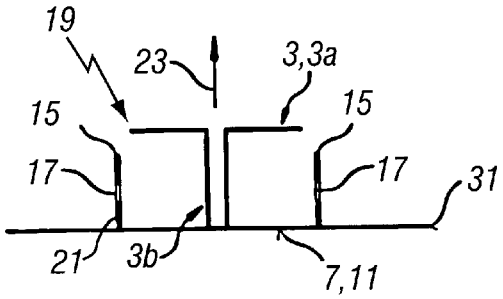
FIG. 2 shows a schematic horizontal cross-sectional illustration through the exemplary embodiment according to FIG. 1.
Figure 5:
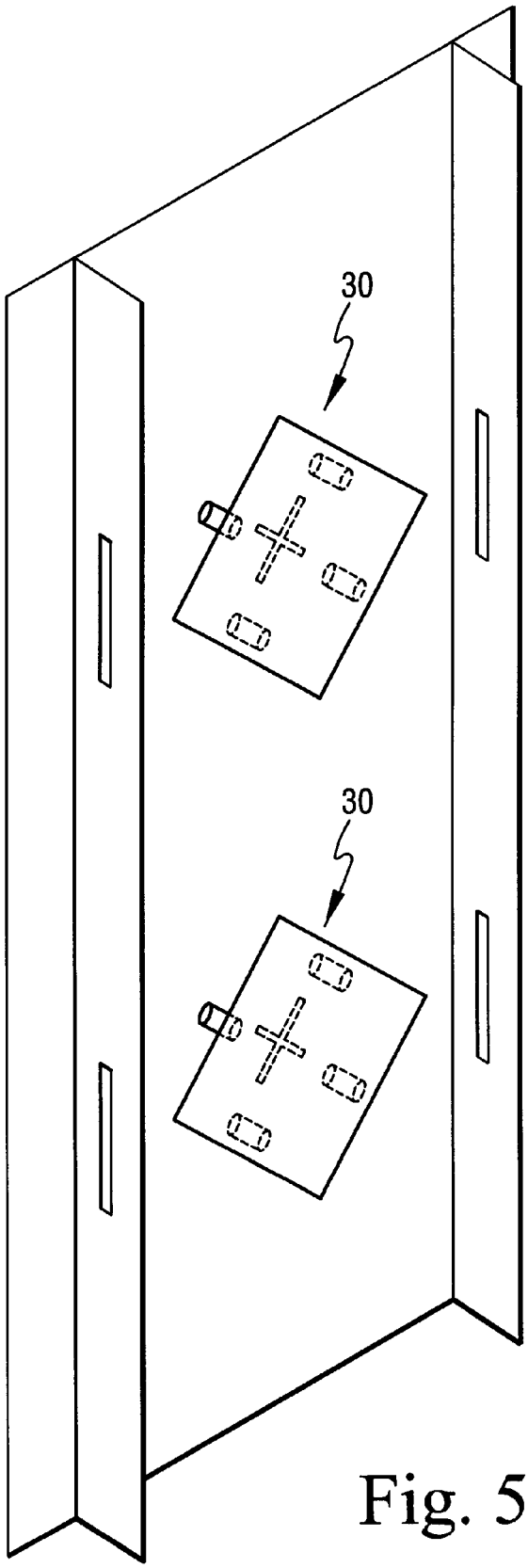
FIG. 5 shows an alternate schematic exemplary embodiment of a dual-polarized antenna system.

In the exemplary embodiment according to FIGS. 1 and 2, a dual-polarized antenna array 1 having a plurality of primary radiating elements aligned vertically is shown, whose radiating element modules 3 are formed like cruciform modules 3*a* or in a form of a patch radiating element 30 (FIG. 5). Other structures in the form of cruciform modules are likewise possible, for example in the form of dipole modules arranged in a square.

This antenna array is constructed such that the radiating element modules 3 are aligned like cruciform modules 3a so that they receive or transmit linear polarizations at angles of +45° and −45° with respect to the vertical (and with respect to the horizontal). Such an antenna array is also referred to as an X-polarized antenna array for short in the following text.

The radiating element modules 3 in the illustrated exemplary embodiment are located in front of a reflecting surface, the so-called reflector 7, thus improving the directionality. They are attached to and held on the reflector 7 by their radiating element feet or balancing elements 3*b*.

In the exemplary embodiment shown, the dipole plane is aligned at +45° or −45° with respect to the vertical, that is to say with respect to the horizontal section plane 9.

Two sidewall sections 15 are provided transversely with respect to this horizontal section plane 9 and transversely with respect to the reflector plane 11, which sidewall sections are spaced apart in the side region 13 of the reflector 7 in the horizontal direction, and extend parallel to one another in the illustrated exemplary embodiment. In the illustrated exemplary embodiment, the sidewall sections 15 are part of the reflector 7 and may be part of a reflector element or plate in which the sidewall sections are formed by bending them up or around.

The sidewall sections 15 are thus aligned transversely, that is to say, in the illustrated exemplary embodiment, at right angles to the reflector plane 11 and project beyond the reflector plane 11, to be precise on the side on which those radiating element modules 3 are arranged which, in a front view of the antenna array 1, are located between the two sidewall sections 15 which run parallel to one another.

Slots 17 are incorporated in each of the sidewall sections 5 at the level of the radiating element modules 3 and extend parallel to the reflector plane 11, and thus parallel to the dipole plane 19, which is defined by the plane in which the dipoles 3, 3*a* are located.

As can be seen from FIG. 2, the distance between the dipole plane 19 and the reflector plane 11 is greater than the distance 21 between the slots 17 and the reflector plane 11.

The position and dimensions of the slots, in particular their longitudinal extent and their width, can be chosen to be different and are preferably matched such that the amplitude and phase of the wave transmitted by the coupled slots, or the transmitted horizontal polarization component of the electromagnetic wave, are such that cancellation occurs in the main beam direction 23 and in the rearward direction, and additive superimpositions are achieved at right angles to the main beam direction, with a phase shift which is as small as possible being achieved with respect to the vertical main polarization component. In this case, a slot length is preferably chosen which is in the region from one quarter of the wavelength up to one complete wavelength.

Furthermore, the polar diagram is modified in the manner already mentioned, in that the radiation characteristic is considerably broadened in the sidelobe direction 25, that is to say in the horizontal transmission direction at the sides in the illustrated exemplary embodiment, this direction being at right angles to the main beam direction and running parallel to the main propagation or horizontal section plane 9, or being located in this main propagation plane 9. The field strength vector which is defined by the dipole alignment and coincides with the main propagation plane 9 is, in other words, transmitted in its sidelobe direction 25 with a considerably greater 3 dB beamwidth, even in the side regions which differ in azimuth from the main beam direction 23.

The said slots 17 thus result in the radiation characteristic being broadened in an objective manner, with the improved radiation characteristic being not only narrowband but also broadband in nature.

The size and position of the slots 17 are in this case preferably matched in an optimized manner such that the parasitic radiating elements which are formed in the manner of slots and radiate weakly, do not radiate at resonance and not in phase but in antiphase.

Figure 3:
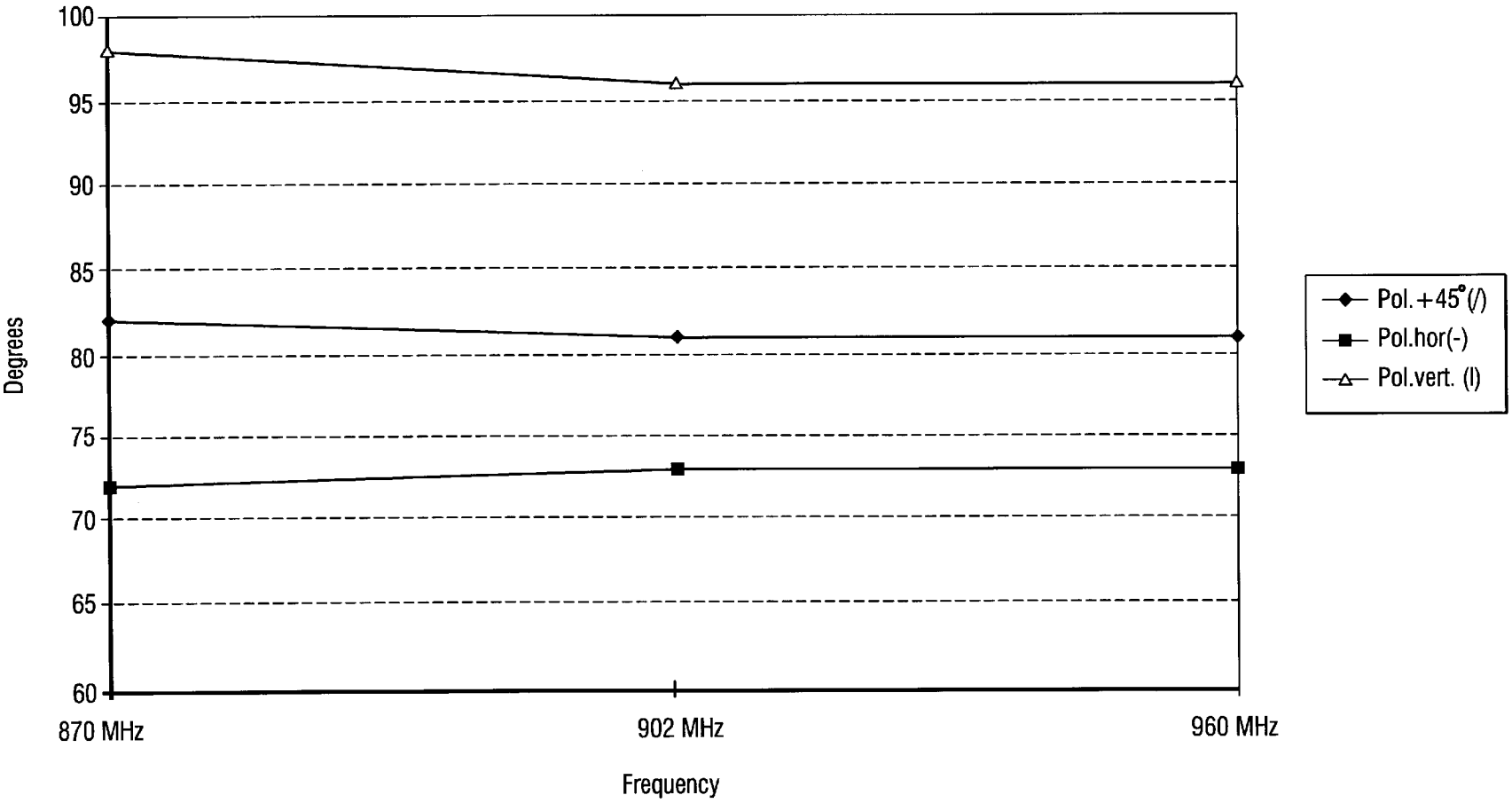
FIG. 3 shows a diagram to explain a polar diagram, using a conventional arrangement.
Figure 4:
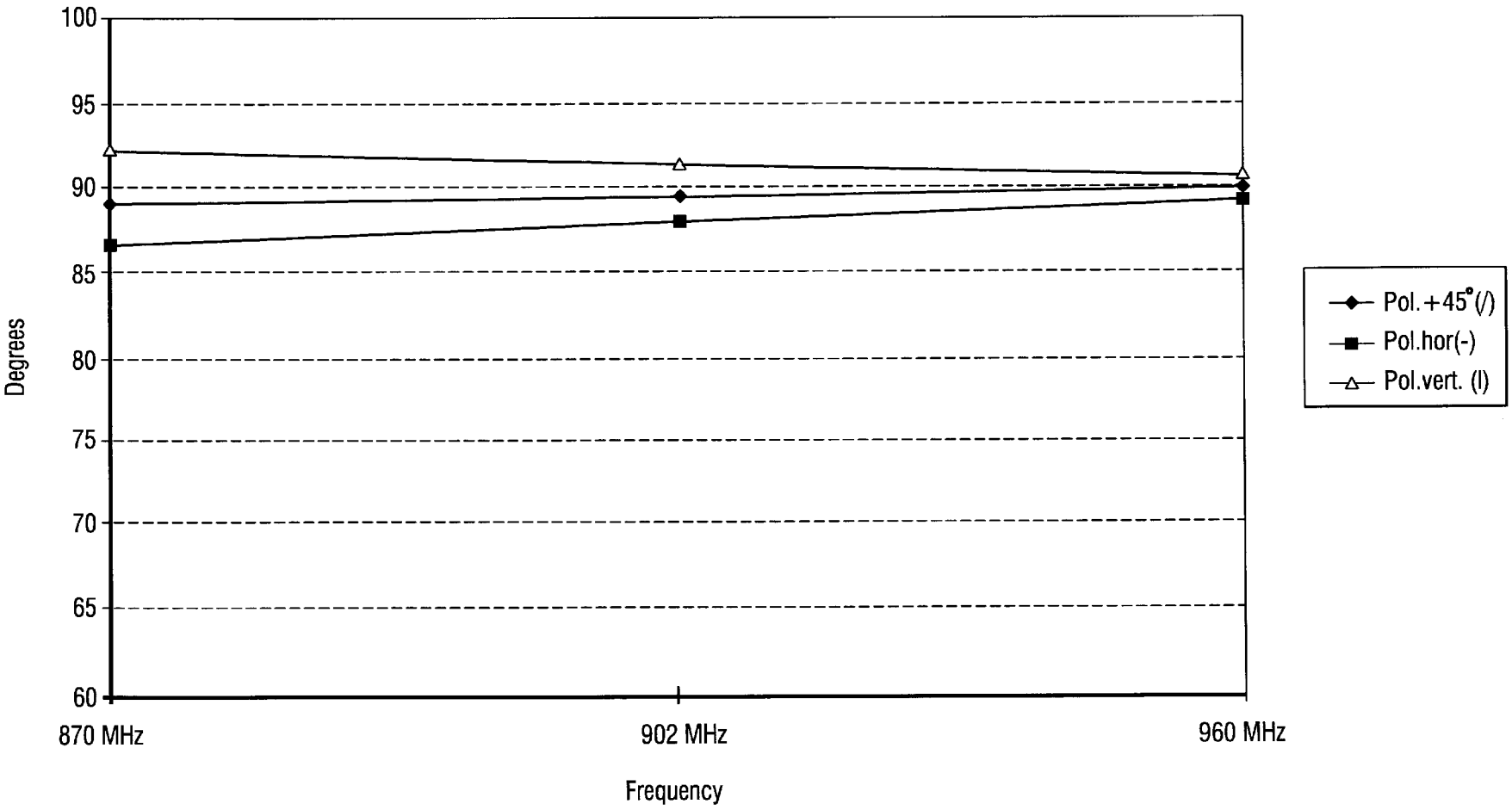
FIG. 4 shows a diagram corresponding to FIG. 3, using a dual-polarized antenna system according to the invention.

The improved radiation characteristic can be seen from diagrams 3 and 4, the diagram according to FIG. 4 showing that the correspondence of the 3 dB beamwidths of the vertical, horizontal and +45°/−45° components, and thus the constancy of polarization in the 3 dB beamwidth in the case of the antenna array according to the invention and, for example, corresponding to FIGS. 1 and 2 being considerably improved in comparison with a conventional arrangement. In this case, the diagrams illustrated in FIGS. 3 and 4 also show that the advantageous improved radiation characteristic can be achieved over a broad band.

Finally, it should be mentioned that the sidewall regions having the slots may each be a separate component, but preferably firmly connected to the reflector. In particular, if a reflector plate or some other material which can be folded or bent is used and has a conductive and thus reflecting surface, the sidewall sections can be produced by folding and bending the reflector plates.

In this case, the sidewall sections do not necessarily need to be arranged on the outer edge region 31 of the reflector 7. They may, in contrast, be arranged offset outward or, as is illustrated in FIGS. 1 and 2, also further inward from the outer edge 31, to be precise forming an outer edge strip 41.

The distance between the slots 17 and the reflector plane 11 is preferably less than the distance between the dipole or cruciform module plane 19 and the reflector plane 11.

What is claimed is:

1. A dual-polarized antenna system for transmitting or receiving electromagnetic waves comprising:

at least one cruciform radiating element module aligned, using dipoles, at angles of +45° and −45° with respect to a vertical direction and also with respect to a horizontal plane perpendicular to said vertical direction, a conductive reflector disposed on a back side of said at least one radiating element module, first and second conductive side wall sections, each disposed in a generally vertical plane on each lateral side of said at least one radiating element module, at least one slot being provided in each said side wall section, the at least one slot being formed in the respective side wall section at a vertical level of a respective radiating element module, at least one of a position and dimensions of each said slot being determined so that the slots radiate other than at a resonance thereof.

2. A dual-polarized antenna system according to claim 1, wherein the slots are disposed in parallel to at least one of a plane of the radiating element module and a plane of the reflector.

3. A dual-polarized antenna system according to claim 1, wherein each said side wall section is disposed generally transversely with respect to at least one of a plane of the radiating element module and a plane of the reflector.

4. A dual-polarized antenna system according to claim 1, wherein a distance between the slots aligned with said at least one radiating element module and a plane of the reflector is less than a distance between a plane of the radiating element module and the plane of the reflector.

5. A dual-polarized antenna system according to claim 1, wherein at least one of the position and dimensions of said slots are matched so that the slots act as secondary or parasitic radiating elements and radiate in antiphase.

6. A dual-polarized antenna system according to claim 1, wherein at least two radiating element modules are provided, one disposed vertically above the other so as to form a vertically aligned antenna array.

7. A dual-polarized antenna system according to claim 1, wherein a plane of the reflector is disposed in parallel to a plane of said radiating element module.

8. A dual-polarized antenna system according to claim 1, wherein said side wall sections are disposed generally transversely with respect to a plane of said reflector.

9. A dual-polarized antenna system for transmitting or receiving electromagnetic waves comprising:

at least one cruciform radiating element module aligned, in the form of a patch radiating element, at angles of +45° and −45° with respect to a vertical direction and also with respect to a horizontal plane perpendicular to said vertical direction, a conductive reflector disposed on a back side of said at least one radiating element module, first and second conductive side wall sections, each disposed in a generally vertical plane on each lateral side of said at least one radiating element module, at least one slot being provided in each said side wall section, the at least one slot being formed in the respective side wall section at a vertical level of a respective radiating element module, at least one of a position and dimensions of each said slot being determined so that the slots radiate other than at a resonance thereof.

10. A dual-polarized antenna system according to claim 9, wherein the slots are disposed in parallel to at least one of a plane of the radiating element module and a plane of the reflector.

11. A dual-polarized antenna system according to claim 9, wherein each said side wall section is disposed generally transversely with respect to at least one of a plane of the radiating element module and a plane of the reflector.

12. A dual-polarized antenna system according to claim 9, wherein at least one of the position and dimensions of said slots are matched so that the slots act as secondary or parasitic radiating elements and radiate in antiphase.

13. A dual-polarized antenna system according to claim 9, wherein at least two radiating element modules are provided, one disposed vertically above the other so as to form a vertically aligned antenna array.

14. A dual-polarized antenna system according to claim 9, wherein a plane of the reflector is disposed in parallel to a plane of said radiating element module.

15. A dual-polarized antenna system according to claim 9, wherein said side wall sections are disposed generally transversely with respect to a plane of said reflector.

* * * * *